US007806289B2

(12) United States Patent
McCandlish et al.

(10) Patent No.: US 7,806,289 B2
(45) Date of Patent: Oct. 5, 2010

(54) CONTAINER CLOSURE

(75) Inventors: Jason Bruce McCandlish, 20 Leslie Street, Suite 205, Toronto, Ontario (CA) M4M 3L4; Kenneth Sheppard Albert Taylor, Sault St. Marie (CA)

(73) Assignee: Jason Bruce McCandlish (CA)

( * ) Notice: Subject to any disclaimer, the term of this patent is extended or adjusted under 35 U.S.C. 154(b) by 732 days.

(21) Appl. No.: 10/493,335

(22) PCT Filed: Oct. 24, 2002 (Under 37 CFR 1.47)

(86) PCT No.: PCT/CA02/01602

§ 371 (c)(1), (2), (4) Date: Oct. 15, 2004

(87) PCT Pub. No.: WO03/035501

PCT Pub. Date: May 1, 2003

(65) Prior Publication Data

US 2007/0164025 A1 Jul. 19, 2007

(51) Int. Cl.
*A47G 19/22* (2006.01)

(52) U.S. Cl. ..... 220/713; 220/212; 220/254.7; 229/404; 229/906.1

(58) Field of Classification Search ..... 220/713, 220/780, 212, 254.7; 229/404, 906.1
See application file for complete search history.

(56) References Cited

U.S. PATENT DOCUMENTS

| | | | | | |
|---|---|---|---|---|---|
| 795,626 | A * | 7/1905 | Lampman | 215/260 |
| 2,218,308 | A * | 10/1940 | Comer | 222/487 |
| 2,698,115 | A * | 12/1954 | Lacher | 222/499 |
| 3,321,114 | A * | 5/1967 | Croyle | 222/499 |
| 3,658,217 | A * | 4/1972 | Collie et al. | 222/463 |
| RE32,927 | E * | 5/1989 | Taylor et al. | 220/780 |
| 5,240,154 | A * | 8/1993 | Van Den Berghe | 222/499 |
| 5,597,096 | A * | 1/1997 | Jeppesen et al. | 222/498 |
| 6,419,105 | B1 * | 7/2002 | Bruce et al. | 220/266 |

* cited by examiner

*Primary Examiner*—Nathan J Newhouse
*Assistant Examiner*—James N Smalley
(74) *Attorney, Agent, or Firm*—Bliss McGlynn, P.C.

(57) ABSTRACT

A closure for a container having a top opening bounded by a rim, includes a generally bowl-shaped body with interior and exterior surfaces and a hole formed on one side of the body. Extending about the body is a connecting section including a skirt and this connecting section seals the body to the container. The interior surface defines an interior space into which the container opens during use of the closure. The body is selectively deformable, upon manual manipulation, between an open configuration wherein fluid can pass through the hole and a closed configuration wherein one of the interior surface and the exterior surface of the body is sealed against the hole. In another embodiment, the closure is formed with a protuberance that projects upwardly from the top surface of the closure. A folding lip is arranged on the front of this protuberance and has a sealable hole formed therein.

12 Claims, 12 Drawing Sheets

CONTAINER CLOSURE

BACKGROUND OF THE INVENTION

The present invention relates to the field of container closures, and more particularly, to a closure for a liquids container which provides for selective release of the contents of such container.

It is well-known to provide closures for liquids containers, such as beverage cups, which provide for selective release of their contents.

One class of closure comprises a one piece construction, with a main cover member that can be secured to the outer periphery of a beverage cup in a conventional manner, and which has a cut-away flap portion that can be selectively displaced between a closed position, whereat the flap is positioned substantially in line with the main cover member, and an open position, whereat the flap projects away from the main cover member, thereby to provide an opening for flow of the liquid contents of the beverage cup. U.S. Pat. No. 4,741,450 (Braude), issued May 3, 1988 and U.S. Pat. No. 5,799,814 (Schaefer et al.), issued Sep. 1, 1998 are both exemplary of this class, which is known to be capable of manufacture at relatively low cost, but can provide an unreliable liquid seal.

Another class of closure comprises two sections joined at their center. The outer section can be secured to the outer periphery of a beverage cup in a conventional manner, and forms an annular well which has a plurality of openings therein. The inner section is stressed such that it normally bears against the openings, thereby to provide a liquid seal between said openings and any contents of the container. When the center of the outer section is depressed, the inner section separates from the openings, thereby to permit fluid contents of the container to flow through the openings.

U.S. Pat. No. 3,797,696 (Debrell), issued Mar. 19, 1974; U.S. Pat. No. 3,727,808 (Fitzergerald), issued Apr. 17, 1973; and U.S. Pat. No. 3,730,399 (Dibrell et al.), issued May 1, 1973, are all exemplary of this latter class, which is known to be capable of providing a relatively liquid-tight seal, but suffers from the need for users to maintain pressure on the centre portion to permit fluid flow, which can be inconvenient.

SUMMARY OF THE INVENTION

The present invention comprises a closure for a container having an aperture bounded by a rim. The closure comprises a substantially bowl-shaped body having an interior surface and an exterior surface and having defined therethrough a passage. The closure further comprises a connection means for sealing the body to the container such that the interior surface in combination with the container defines an interior space into which the aperture opens during use of the closure. The body is selectively deformable, upon manual manipulation, between an open configuration, wherein the passage is in fluid communication with the aperture, and a closed configuration, wherein one of the interior surface and the exterior surface is sealed against the passage.

Other advantages, features and characteristics of the present invention, as well as methods of operation and functions of the related elements of the structure, will become more apparent upon consideration of the following detailed description with reference to the accompanying figures, which are briefly described hereinbelow.

DETAILED DESCRIPTION

Figure 1:
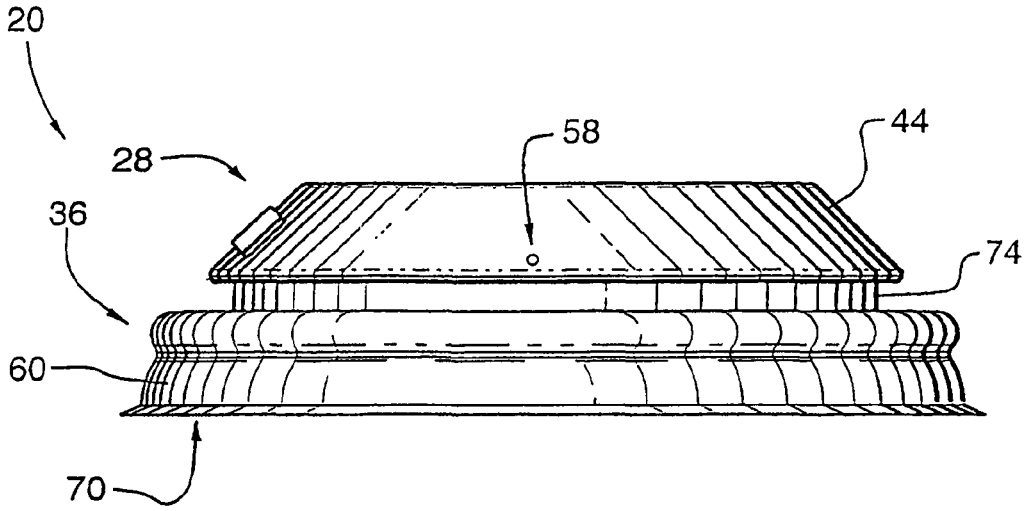
FIG. 1 is a side elevational view of a closure according to a first embodiment of the present invention, with a body portion shown in the closed configuration.
Figure 10:
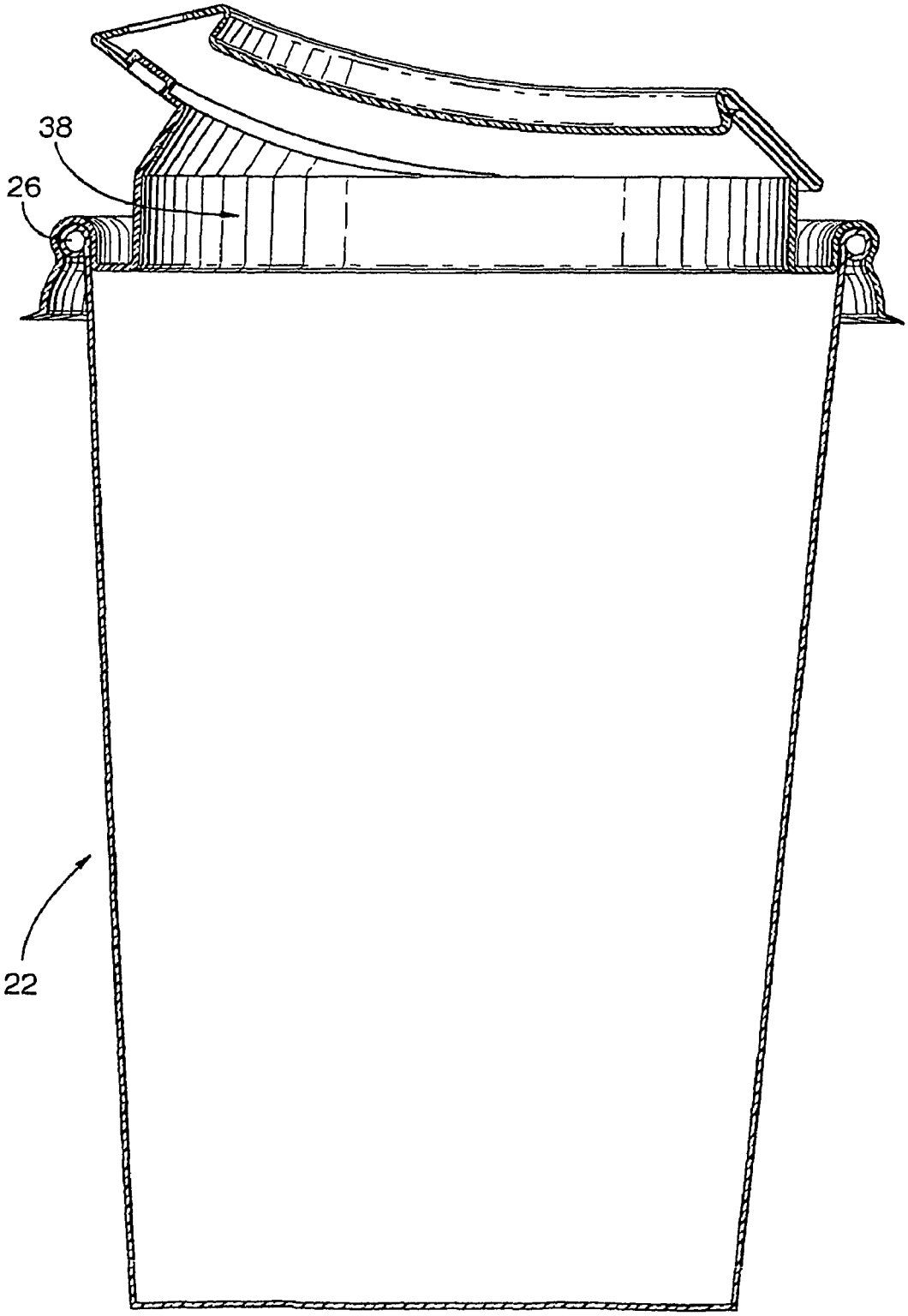
FIG. 10 is a view similar to FIG. 7, showing the closure sealed to a container.

With reference to FIG. 1, a preferred embodiment of the closure of the present invention is illustrated and designated with general reference numeral 20. As illustrated in FIG. 10, the closure 20 is for a container 22 having an aperture or open top bounded by a rim 26, such as a disposable coffee cup. For clarity, it should be understood that the container 22 does not form part of the invention.

Figure 2:
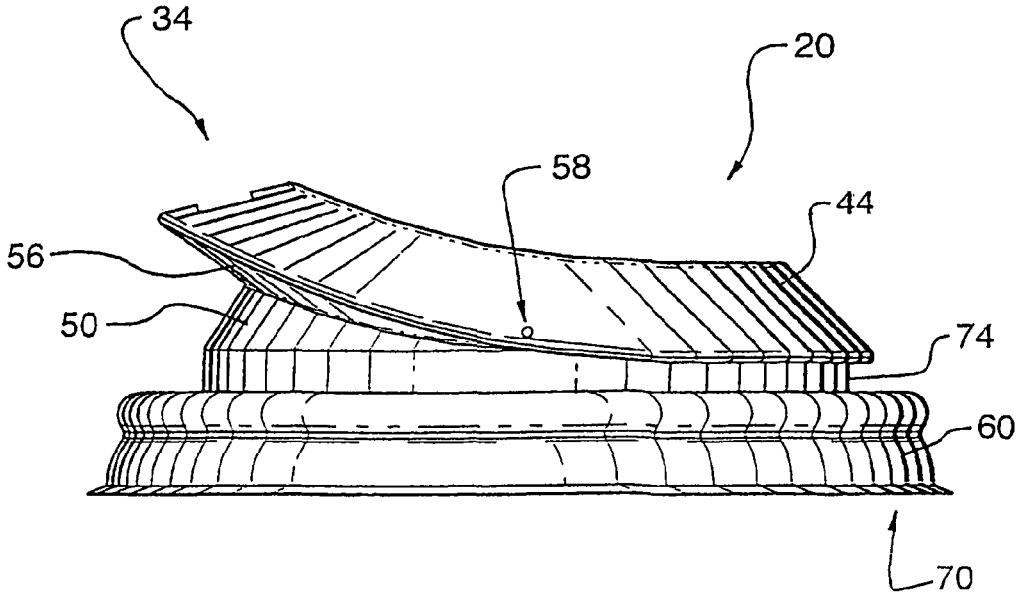
FIG. 2 is a view similar to FIG. 1, shown with the body in the open configuration.
Figure 3:
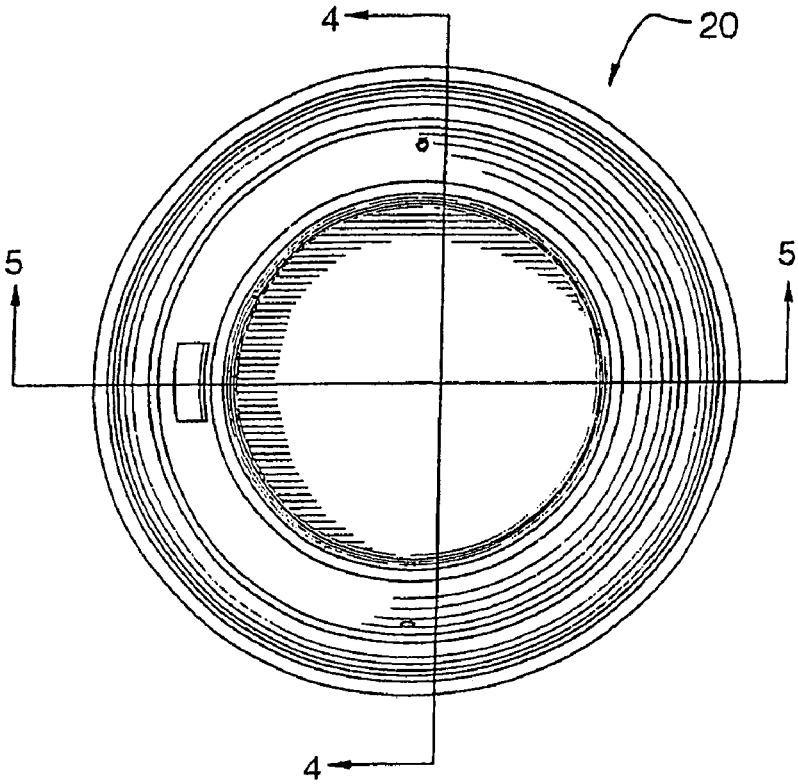
FIG. 3 is a plan view of the closure of FIG. 1.
Figure 4:
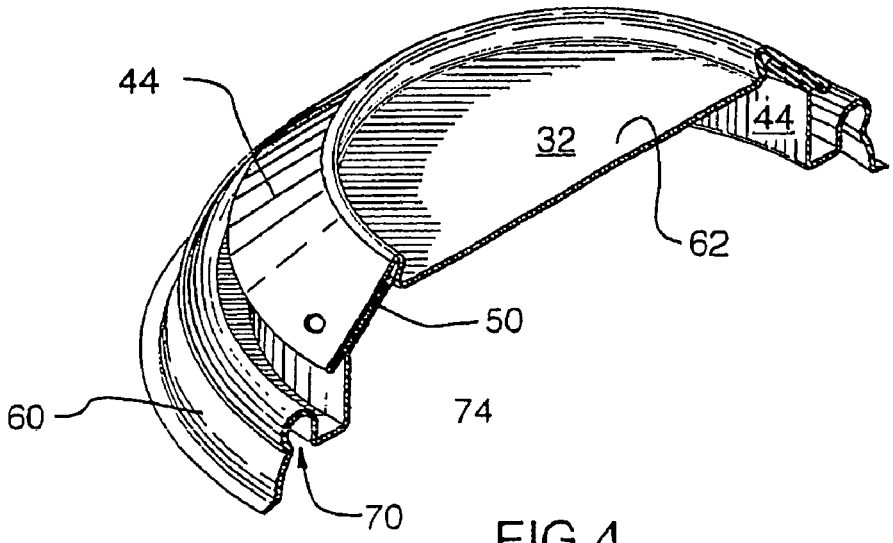
FIG. 4 is a perspective cross-sectional view of the closure of FIG. 1, viewed along line 4-4 of FIG. 3.
Figure 5:
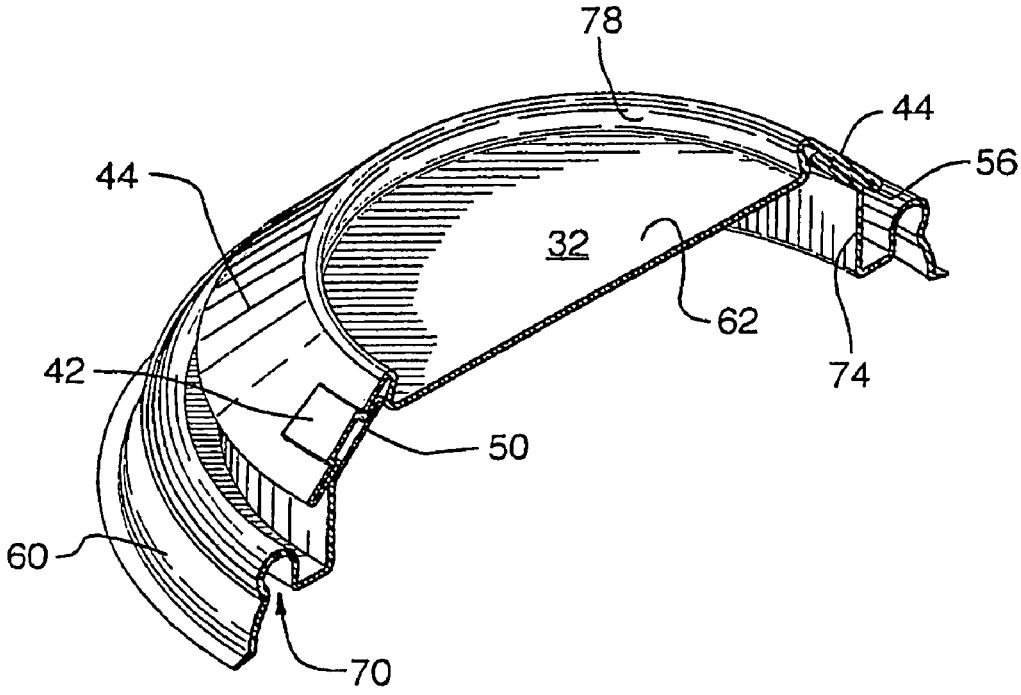
FIG. 5 is a perspective cross-sectional view of the closure of FIG. 1, viewed along line 5-5 of FIG. 3.
Figure 7:
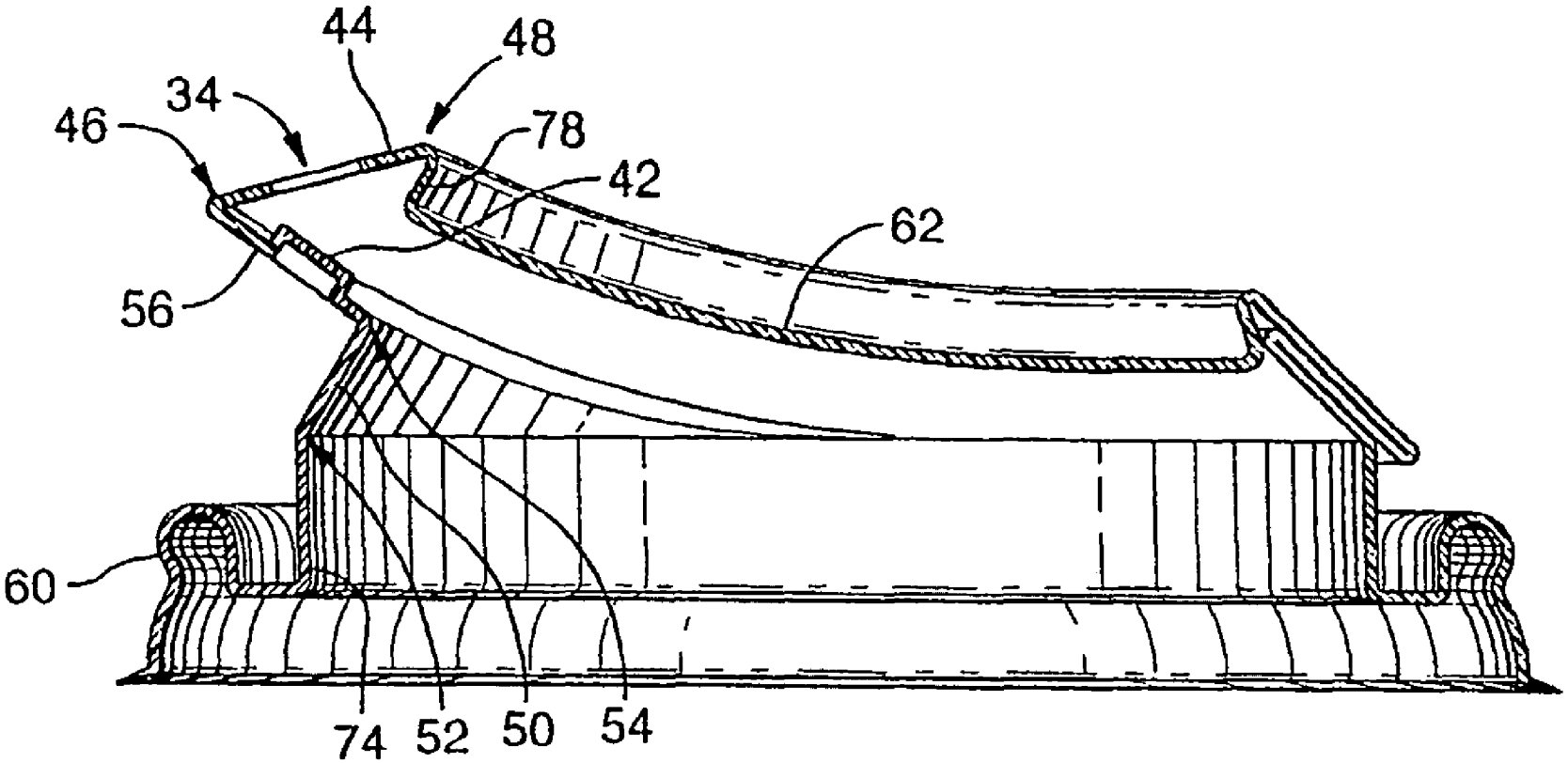
FIG. 7 is a view similar to FIG. 6, with the body in the open configuration.

As indicated in FIG. 1, the closure 20 comprises a substantially bowl-shaped body 28. Generally, the body 28 has an interior surface 30, best seen in FIG. 4, and an exterior surface 32 and has defined therethrough a passage or aperture 34, as illustrated in FIG. 2 and FIG. 7. The closure 20 further comprises connection means for sealing the body 28 to the container 22 such that the interior surface 30 of the body 28, in combination with the container 22, defines an interior space 38 into which the aperture opens, as indicated in FIG. 10. The connection means is designated with general reference numeral 36 in FIG. 1, and comprises a skirt 60 which extends peripherally around and is operatively connected to the body 28, the skirt 60 having a peripherally extending groove 70 therein, as indicated in FIG. 4, shaped and dimensioned to frictionally, sealingly, releasably receive the rim 26.

When so sealed to the container 22, the body 28 may be selectively deformed, by manual manipulation, between a closed configuration, as illustrated in FIG. 1, wherein the interior surface 30 is sealed against the aperture 34 to resist fluid flow, and an open configuration, as illustrated in FIG. 10, wherein the passage or aperture 34 is in fluid communication with the interior space, to permit fluid flow. Advantageously, a pair of vent holes 58 are formed in the body 28 (actually, in an annular sheath part 44 of the body 28, described more fully in the following paragraph) on circumferentially opposite sides of the passage 34 to facilitate fluid egress, and avoid vacuum lock.

Figure 6:
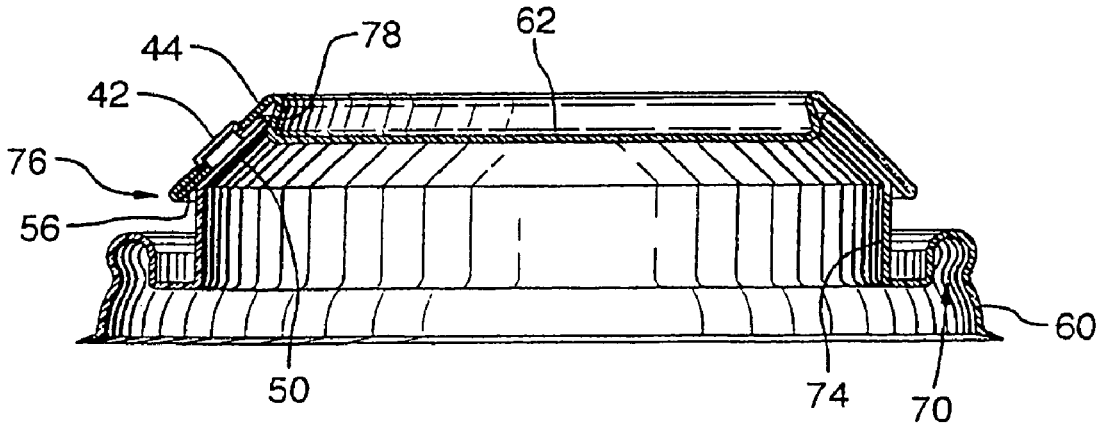
FIG. 6 is a side cross-sectional view of the closure of FIG. 1, Viewed along line 5-5 of FIG. 3.

The structure of the body 28 will now be described in more detail with reference to FIGS. 6 and 7, and will be seen to comprise a cap part 62; the aforementioned sheath part 44; an insert part 50; and an intermediate part 56. The sheath part 44, which has the passage 34 formed therein, has a first end 46 and a second end 48 and is frustoconical, tapering in external dimension towards the second end 48, which is occluded by and rigidly connected to the cap part 62. The insert part 50 also has a first end 52 and a second end 54, the second end 54 being shaped and dimensioned to be received within the sheath part 44. The intermediate part 56 extends between the first end 46 of the sheath part 44 and the second end 54 of the insert part 50, and flexibly connects same for relative movement, upon manual manipulation, from the open position, seen best in FIG. 7, where the insert part 50 and the intermediate part 56 are disposed exteriorly relative to the sheath part 44, to the closed configuration, where the second end 54 of the insert part 50 (in fact, the entire insert part 50) is disposed, in substantially form-fitting, nested relation, within the intermediate part 56, and the intermediate part 56 is disposed, in substantially form-fitting, nested relation, within the sheath part 44, as indicated in FIG. 6. (It will be evident that during manual manipulation from the open configuration to the closed configuration, the intermediate part 56 collapses into the sheath part 44 and the second end 54 of the insert part 50 collapses into the intermediate part 56.)

As indicated above, the foregoing alone provides for selective release of any liquid contents of the container 22, but to further improve the seal, the interior surface 30 is formed with a protuberance 42 which projects through the passage 34 in a sealing manner when the body 28 is in the closed configuration, as indicated in FIG. 1 and FIG. 6. Additionally, the cap 62 forms an interiorly disposed protuberance having an outwardly tapering frustoconical sidewall 78 which, when the body 28 is in the closed configuration, sealingly engages against the junction of the intermediate part 56 and the insert part 50, so as to yet further increase the effectiveness of the seal.

In the preferred embodiment, the open configuration is a static open configuration wherein the body 28 is stable without an external application of force, and the closed configuration is a static closed configuration wherein the body 28 is stable without an external application of force; in fact, the body 28 is constructed of a resilient plastic and is of the "over centre" variety, which is unstable at locations intermediate the open and closed position, and thus, self-biasing into one of the open and closed configuration, depending upon the relative locations of the various parts.

So as to facilitate manual manipulation of the so-biased body 28 from the closed position to the open position, a tubular pedestal part 74 is provided which rigidly extends between and connecting the first end 52 of the insert part 50 to the skirt 60, and the first end 52 of the insert part 50 is constructed of smaller external dimension than the first end 46 of the sheath part 44, thereby to define, in the closed configuration, an overhanging lip designated with general reference number 76 in FIG. 6, which can be pried upwardly by the fingers of a user.

Figure 8:
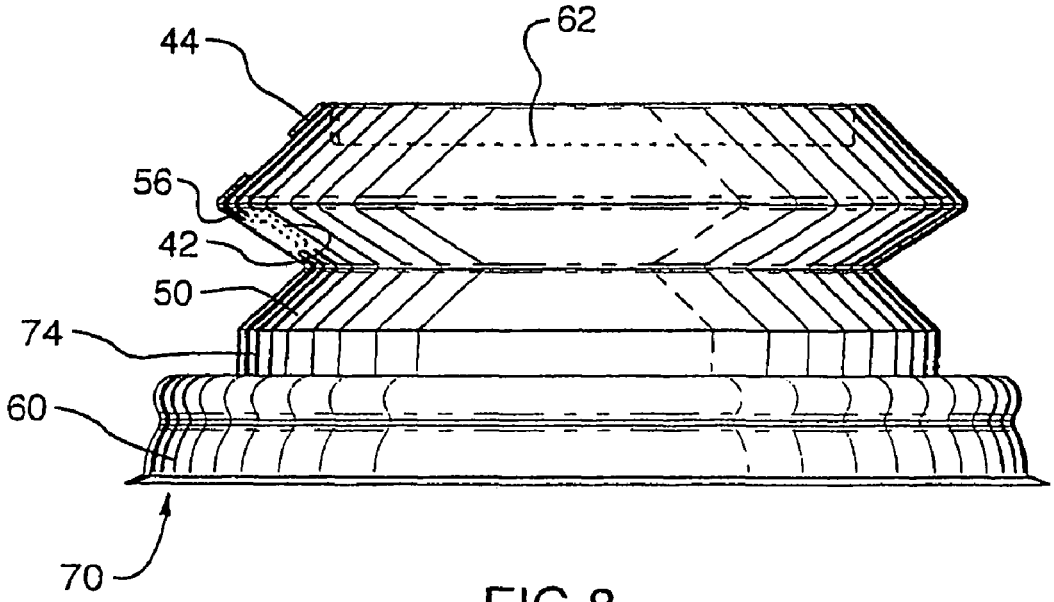
FIG. 8 is a side elevational view of a structure which can be used to form the closure of FIG. 1.

The closure 20 may be constructed from the structure 68 illustrated in FIG. 8 wherein each of the sheath part 44; intermediate part 56; and insert part 50 take the form of a substantially frustoconical annulus connected to one another (preferably, formed integrally) in alternating orientation. With this structure, the intermediate part 56 is collapsed into the sheath part 44 and the insert part 50 collapsed into the intermediate part 56, and thereafter, the sheath part 44 is affixed, by sonic welding, adhesive or the like, to the insert part 50 at the side opposite to that in which the passage 34 is formed, so as to arrive at the preferred embodiment illustrated in FIG. 9 (and FIG. 1).

Figure 11:
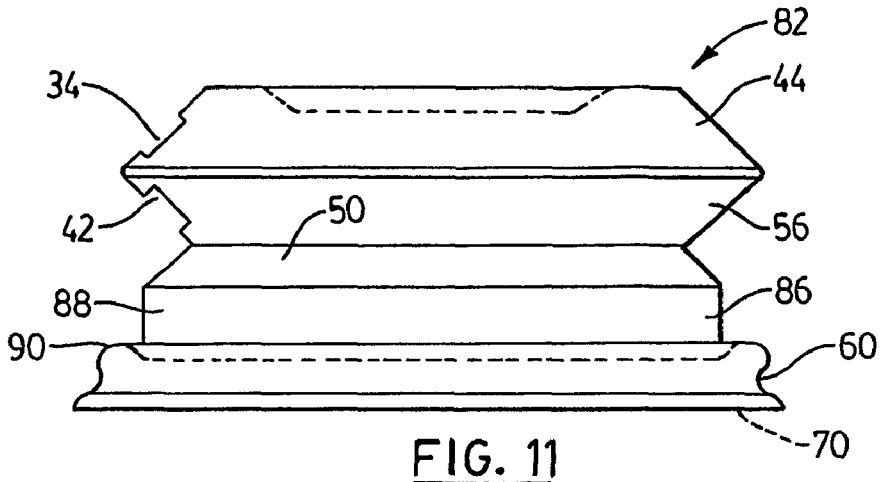
FIG. 11 is a side elevational view of a closure according to a further embodiment of the invention, the closure being shown in the open position.
Figure 12:
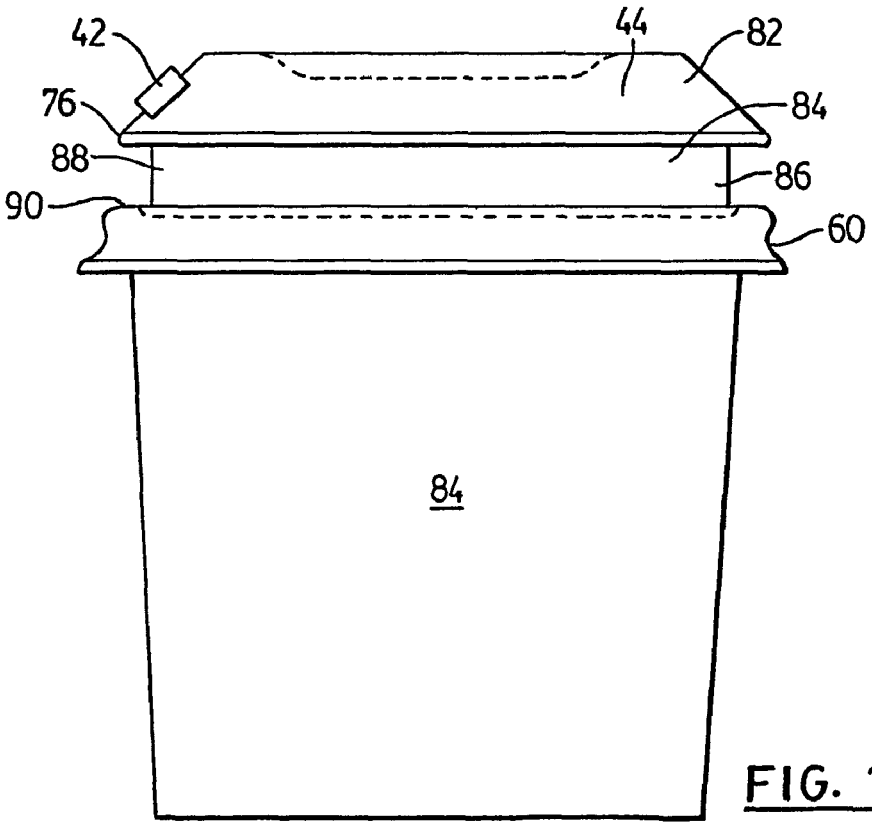
FIG. 12 is a side elevational view of the closure of FIG. 11 mounted on a cup, the closure being shown in the closed position.
Figure 13:
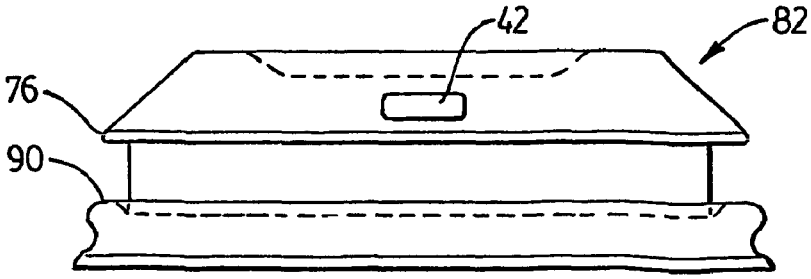
FIG. 13 is a front elevational view of the closure of FIG. 11, the closure being shown in the closed position.
Figure 14:
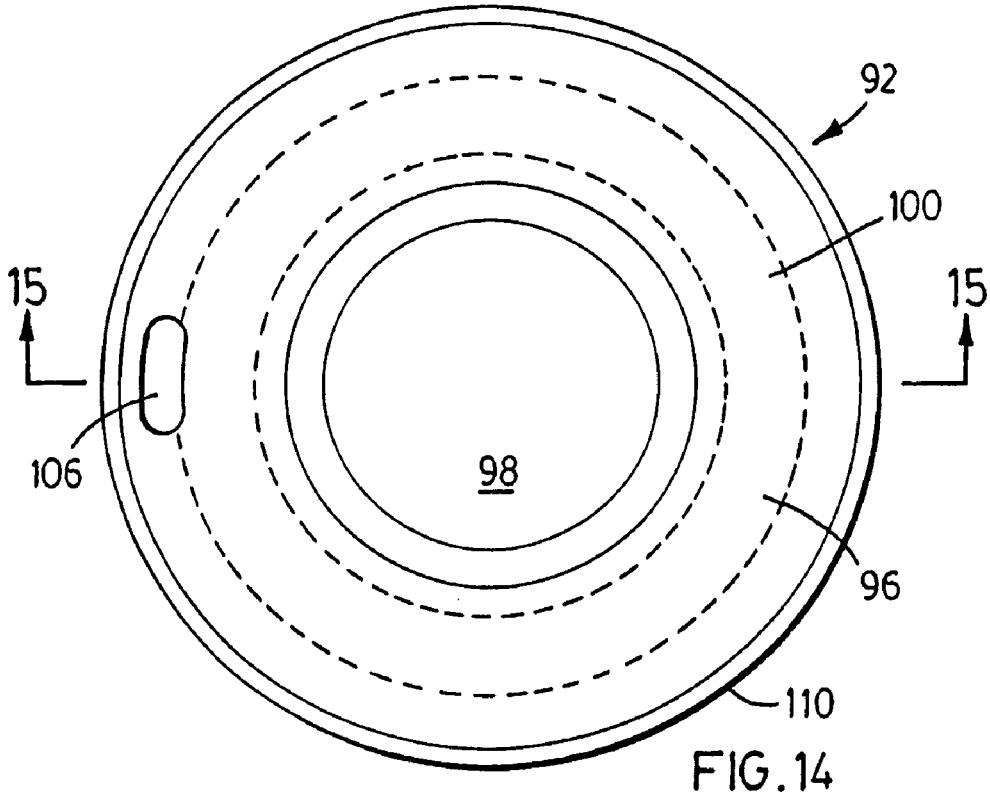
FIG. 14 is a top view of another closure constructed according to the invention, this version having an outwardly projecting rim when mounted on a cup.

FIGS. 11 to 13 illustrate another embodiment of a closure suitable for use on a coffee cup, for example. This closure 82 is similar to the closure illustrated in FIGS. 8 and 9 of the drawings, except for the differences noted hereinafter. In FIG. 12, the closure 82 is shown mounted on the annular rim of a coffee cup 84. The closure 82 has an annular connection means as well for sealing its body to the cup, this connection means including a skirt 60 which is integrally connected to the body 84 of the closure. As with the previous embodiments, the skirt forms an annular groove 70 which is shaped and dimensioned to frictionally and sealingly receive the rim of the cup.

Figure 9:
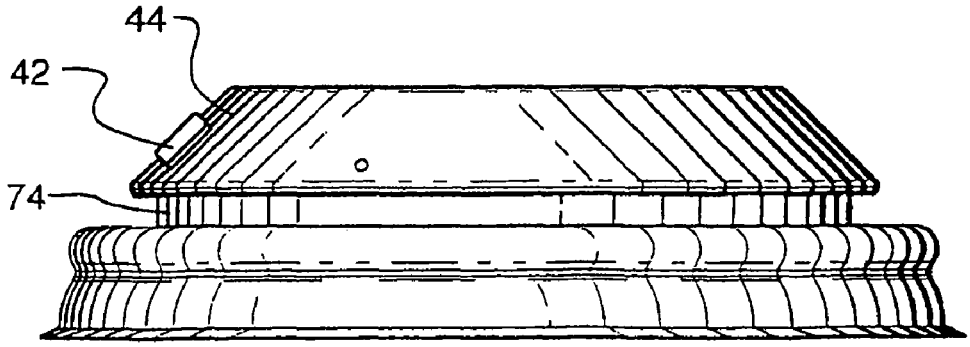
FIG. 9 is a view similar to FIG. 8, showing the structure of FIG. 8 formed into the closure of FIG. 1.

A primary difference between the embodiment of FIGS. 11 to 13 and that of FIGS. 8 and 9 is the height of its tubular, pedestal part 88 which is substantially greater than the above described pedestal part 74. In a particular preferred embodiment of this version, the height of the pedestal part 88 is in the range of 1 cm to 2 cm and it is most preferably close to 1 cm. Because of the greater height of the pedestal part 88, it can be easier for the user of this closure to manipulate the closure from the closed position illustrated in FIG. 12 to the open position. It will be seen that in the closed position shown in FIG. 12, the closure has an overhanging lip 76 which is spaced a substantial distance above an upper rim 90 of the closure.

It will be understood that the closure 82 is also provided with an insert part 50 visible in FIG. 11 and the upper end of this part is integrally connected to an outwardly sloping intermediate part 56. The passage 34 of this closure is also formed in the sheath part 44.

Figure 15:
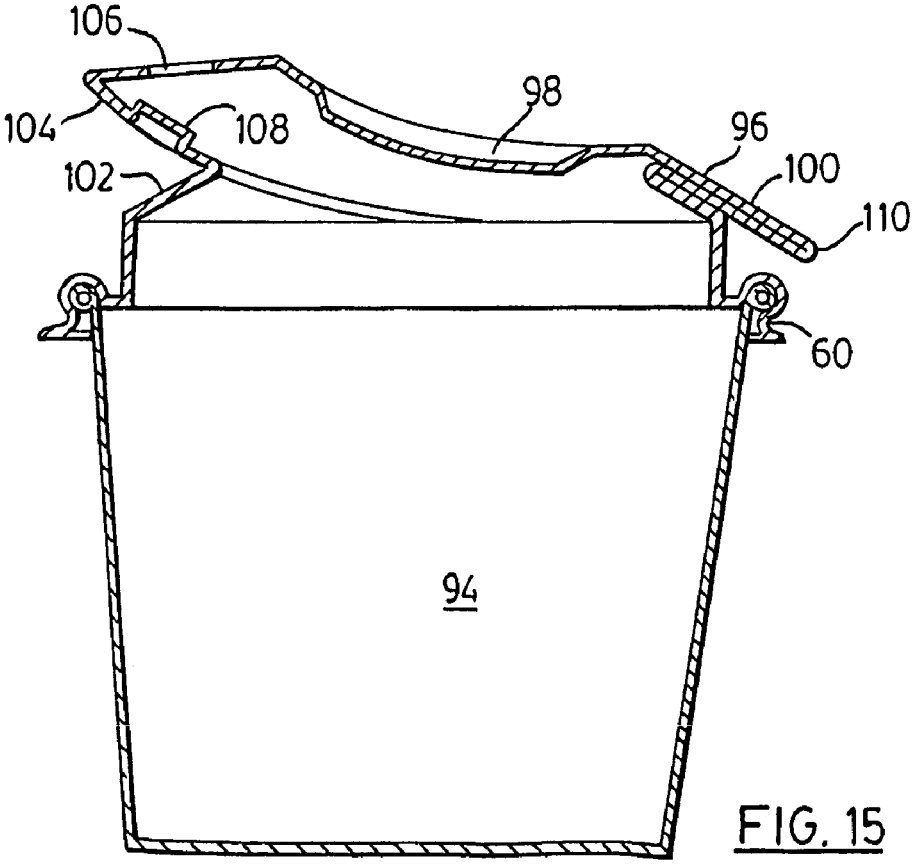
FIG. 15 is a vertical cross-sectional view of the closure of FIG. 14 mounted on a cup, this view being taken along the line 15-15 and the closure being shown in an intermediate open position.

Turning now to another preferred embodiment of a closure constructed in accordance with the invention, this embodiment is illustrated in FIGS. 14 to 17. This closure is indicated generally at 92. Again, it will be understood that this embodiment is constructed generally in accordance with the embodiment of FIGS. 8 and 9 described above, except for the differences noted hereinafter. FIG. 15 illustrates the closure 92 mounted on a cup 94 which can, for example, be a standard coffee cup. This closure is also fitted with means for connecting the body 96 of the closure to the cup, these means including the skirt 60 which extends peripherally around the bottom of the closure and which forms a groove to frictionally and sealingly receive the rim of the cup. The closure 92 includes an upper cap part 98, a downwardly sloping sheath part 100, an insert part 102 visible clearly in FIG. 16, and an intermediate part 104. The sheath part 100 has a passage or hole 106 formed therein. Formed on the intermediate part 104 is a protuberance 108 which of course projects through the hole 106 when the body of the closure is in the closed position.

A significant distinction between the construction of this embodiment and that illustrated in FIGS. 1 to 9 is that this embodiment has an outwardly projecting, annular lip 110 which makes the closure easy to manipulate in order to move the closure from the fully closed position to the intermediate, open position of FIG. 15. As clearly illustrated by FIGS. 15 and 17, the lip 110 projects beyond the skirt 60 a short distance making it relatively easy for the user's thumb or finger to push the projecting lip upwardly in order to move the closure to the open position.

Again, in this embodiment, it will be appreciated that in the closed position, the intermediate part 104 is collapsed into the sheath 100 and the insert part 102 is collapsed into the intermediate part 104.

It will be understood that in the embodiment of FIGS. 14 to 17 it is not necessary for the tubular pedestal part 110 to be as high as in the embodiment of FIGS. 11 and 12. In fact, this pedestal part 110 can be constructed with the same height as the embodiments of FIGS. 1 to 9.

Figure 16:
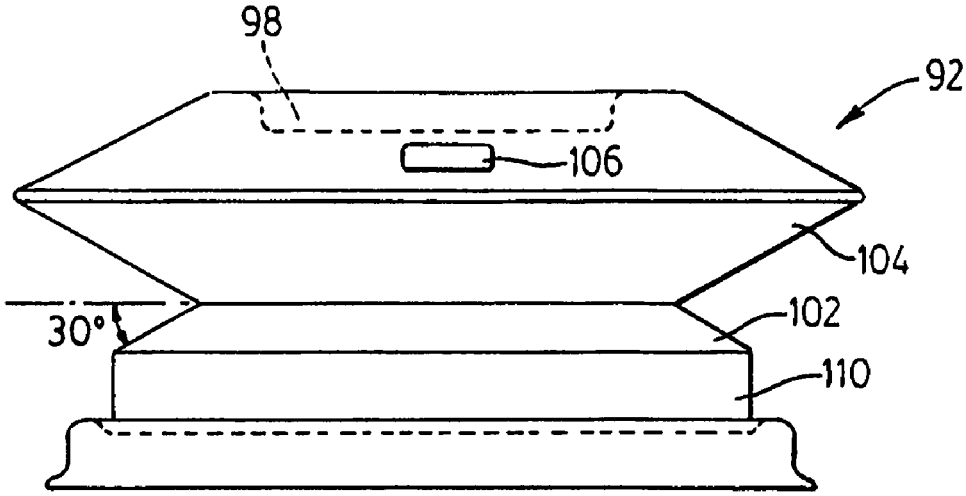
FIG. 16 is a side elevational view of the closure of FIG. 14, the closing being shown in the fully raised position.
Figure 17:
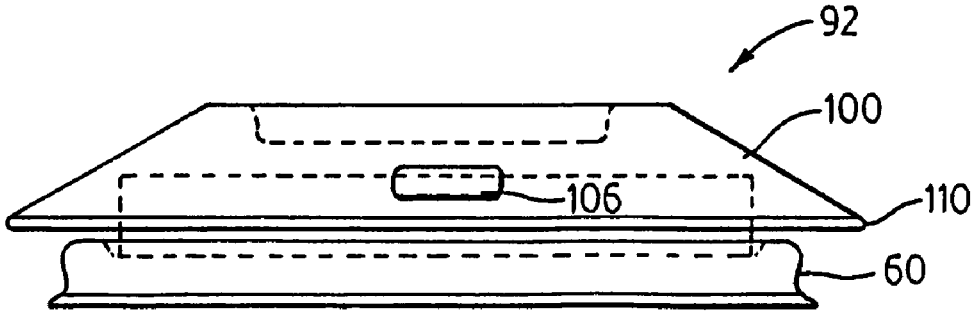
FIG. 17 is a side elevational view of the closure of FIG. 14, the closure being shown in the closed position.
Figure 18:
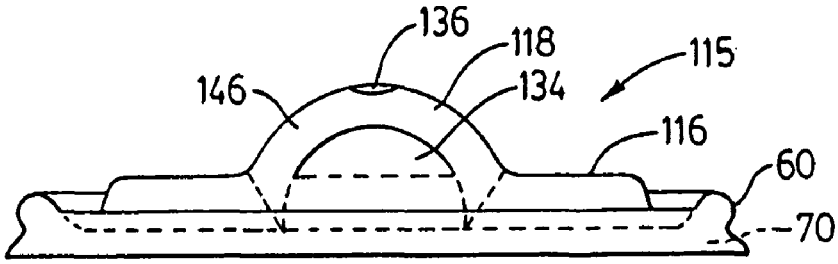
FIG. 18 is a front elevational view of yet another embodiment of the closure according to the invention.

FIG. 16 illustrates the preferred angle of slope of the insert part 102. In particular, it has been found that in order for the closure to operate in a most desirable manner, the slope of the insert part 102 is approximately thirty degrees to the horizontal plane (assuming that the bottom of the closure is horizontal). Similarly, the preferred slope of the intermediate part 104 is also about thirty degrees to the horizontal either in the closed position or in the fully opened position illustrated in FIG. 16.

Yet another form of closure suitable for a coffee cup or similar container is that illustrated in FIGS. 18 to 21 of the drawings. This closure is indicated generally at 115. This closure has a primarily flat body 116 except for a relatively large, upwardly projecting protrusion 118. The closure 115 has means for connecting the body 116 to a container such as the container illustrated in FIG. 10 and this connection means includes a skirt 60 which extends around the circumference of the body. As in the previous embodiments, this skirt forms a peripherally extending groove 70 which is shaped to frictionally and sealingly receive the cup rim.

Figure 19:
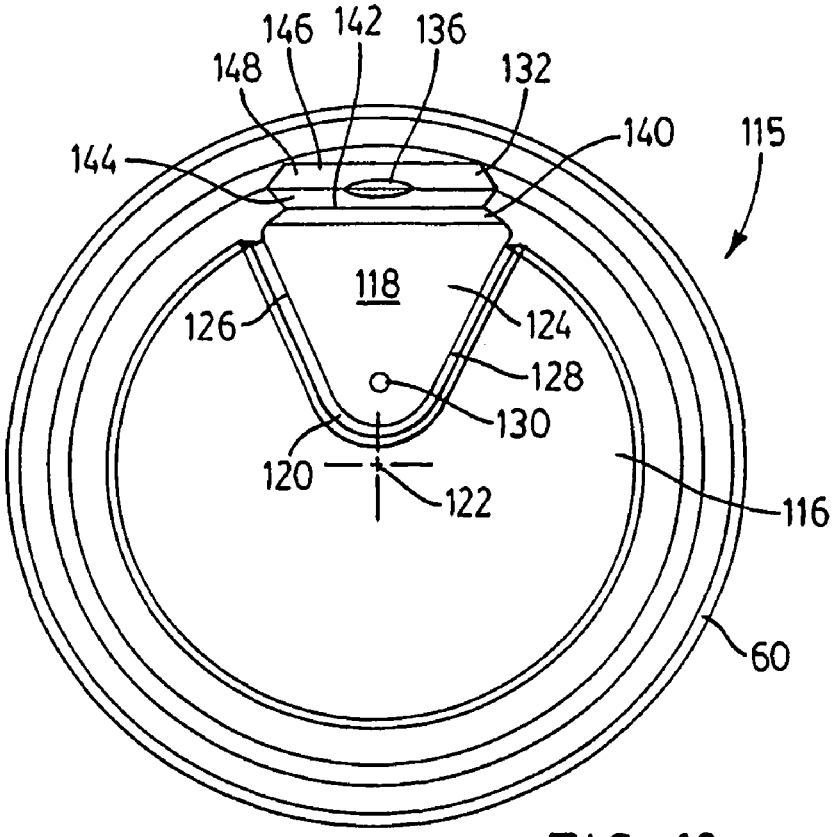
FIG. 19 is a top view of the closure of FIG. 18, the closure being shown in the open position.
Figure 20:
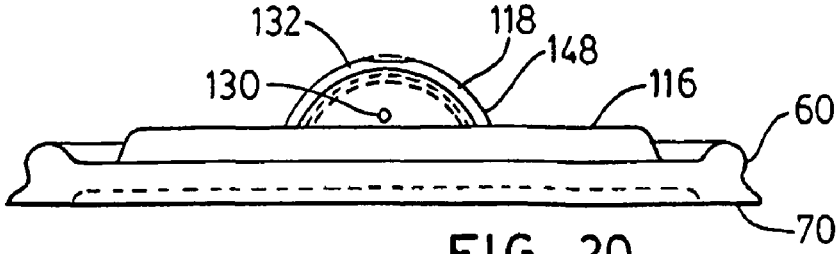
FIG. 20 is a rear elevational view of the closure of FIG. 18.

The aforementioned protrusion 118 can have a generally triangular shape in plan view as shown in FIG. 19 with a rounded inner end at 120. This inner end can be located close to the centre 122 of the closure. The top surface 124 of the protrusion is rounded, forming a convex curve extending from one side 126 to an opposite side 128. Optionally, there can be formed a small air hole 130 near the inner end 120 to avoid vapour lock.

Figure 21:
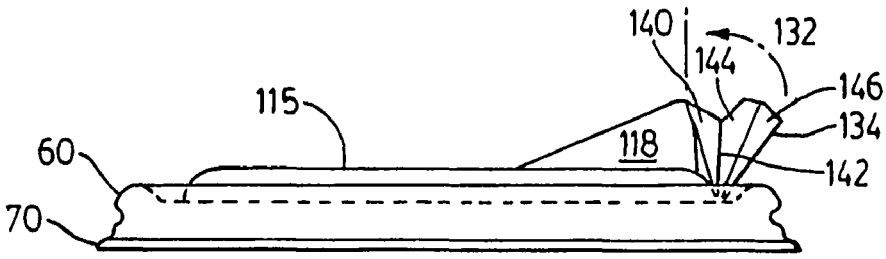
FIG. 21 is a side elevational view of the closure of FIG. 18.

As can be seen in FIGS. 19 and 21, integrally attached to the protrusion is a folding lip 132. This lip extends about the upper perimeter of a semi-circular front wall 134 which effectively closes the front side of the protrusion. Formed in the upper extremity of the lip is a small hole 136 which, in the case of a coffee cup lid, can be a drinking hole.

To break down the construction of this embodiment further and with particular reference to FIGS. 19 and 21, the protrusion is formed with an intermediate wall section 140 and the folding lip 132 is integrally connected to a front edge 142 of this wall section. Furthermore, the folding lip 132 includes a rear wall section 144 and a forward wall section 146 which are connected together along a fold line 148. Also note that the hole 136 is located along the fold line 148 and it extends only a short distance into the two wall sections 144, 146.

With this construction, it will be appreciated that in order to close the opening 136, it is simply necessary to push backwardly on the front wall 134 in order to collapse the folding lip 132 against the protrusion 118. In this way, the forward wall section 146 will collapse against the rear wall section 144 of the lip. In addition, by further pressure on the folding lip, the lip will collapse against the intermediate wall section 140 and it will be held in this collapsed position by the "over center" configuration that results. In other words, the rear wall section 144 will collapse against the intermediate wall section 140 and will be held in this position. Of course, because the forward wall section 146 is resting tightly against the rear wall section 144 in this position, the hole 136 is effectively closed, preventing fluid from escaping through this hole.

Figure 24:
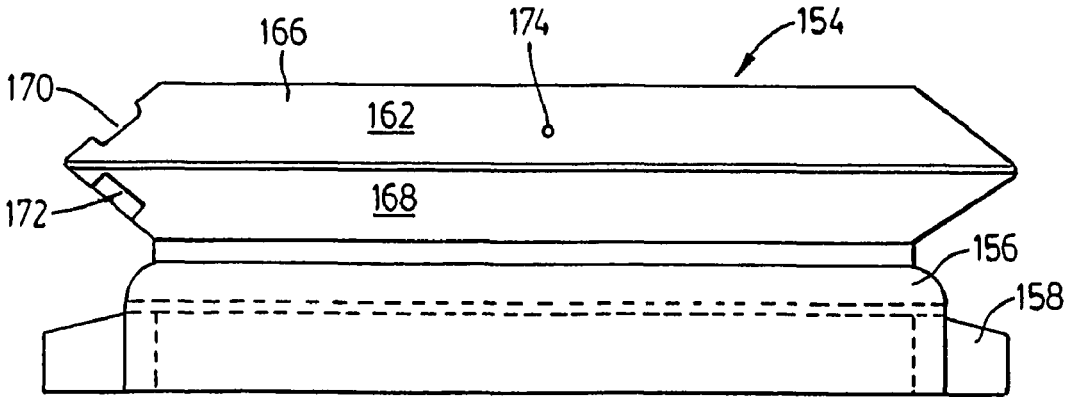
FIG. 24 is a side elevational view of the closure of FIG. 22, the closure being shown in the fully raised position.
Figure 22:
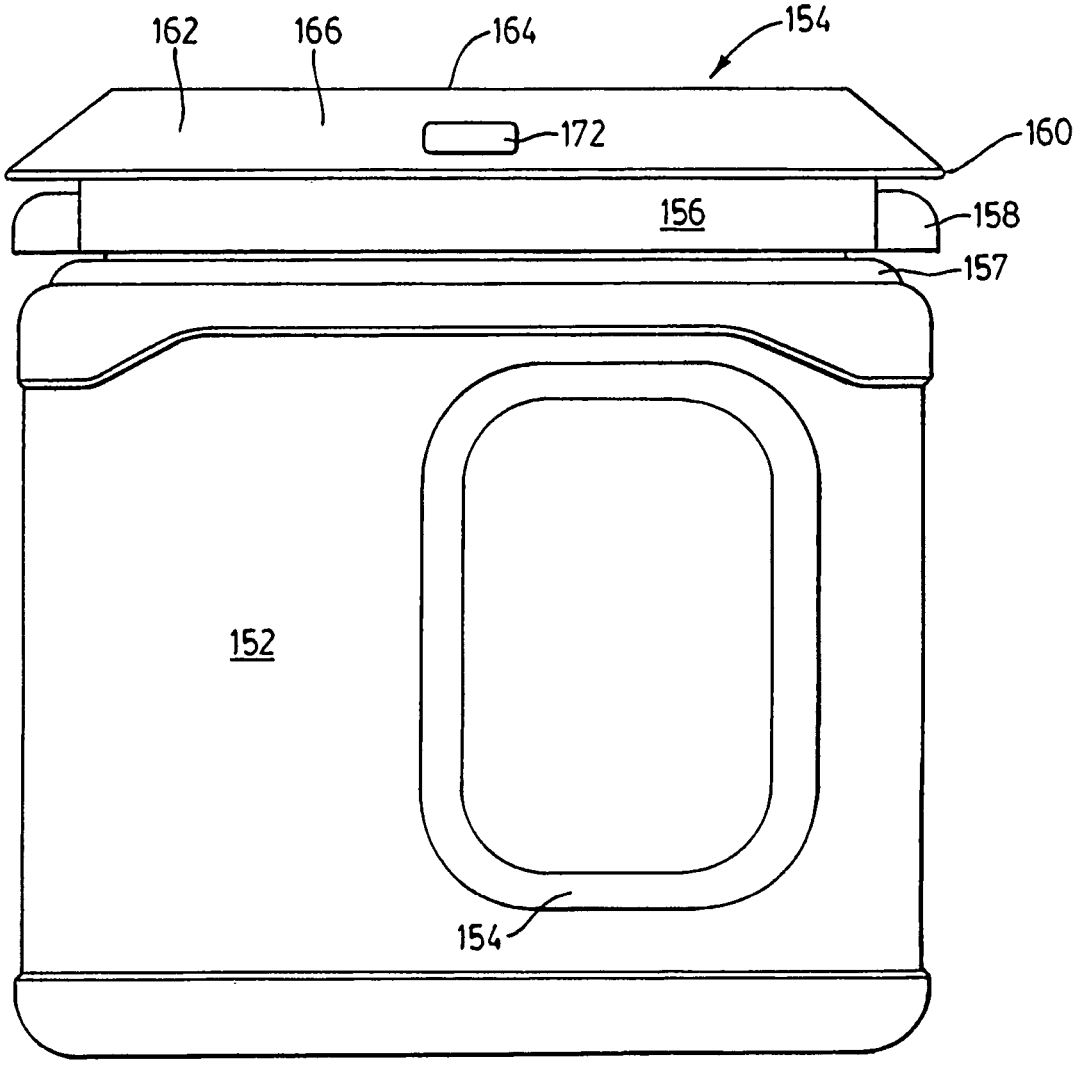
FIG. 22 is a side elevational view of a container such as a paint can fitted with still another form of closure according to the invention, the closure being shown in the closed position.
Figure 23:
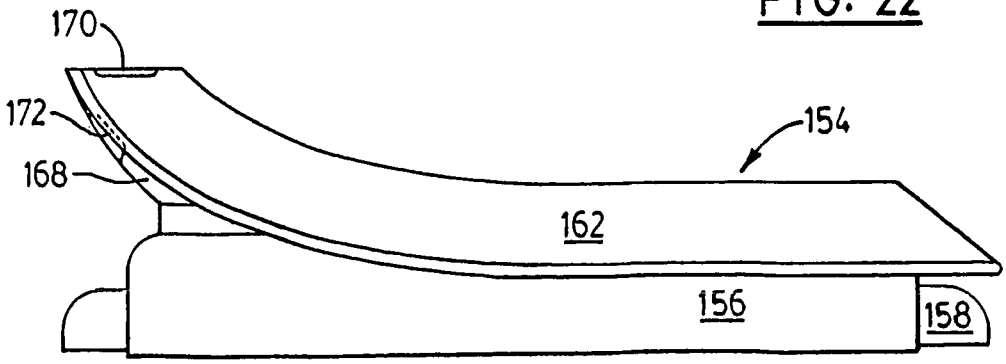
FIG. 23 is a side elevational view of the closure of FIG. 22, the closure being shown in an intermediate open position.

FIGS. 22 to 24 illustrate yet another embodiment of a closure constructed in accordance with the invention, this embodiment being particularly suitable for use on a larger container such as paint can 152. The closure of this embodiment is designated generally by reference 154. The illustrated paint can can be per se of known construction except for the construction of the illustrated closure. In particular, the can can be equipped with a handle 154 as illustrated but it will be understood that the closure 154 is equally suitable for a paint can having no handle. Also, the can 152 is equipped with external connecting threads located at its top end 156. The threads themselves cannot be seen in FIG. 22 as they are covered by the bottom portion of the closure 154. In any event, these threads are standard construction and they permit a threaded closure or top for the paint can to be detachably connected to the can in an efficient, sealable manner.

It will be understood that the closure 154, except for the differences noted hereinafter, can be constructed in a manner similar to the closure illustrated in FIGS. 8 and 9 and described above. A primary difference of the closure 154 is that it is fitted with an internally threaded skirt at 156 that forms the bottom portion of the closure. It will be understood that the internal threads (not shown) are dimensioned and arranged to cooperate smoothly with the external threads formed on the top portion of the paint can. A preferred optional feature of this closure is that it is fitted with a skirt extension 158. The skirt extension may be formed with a rippled or corrugated outwardly facing wall that permits it to be easily gripped for turning purposes. It will also be noted that the skirt extension extends radially beyond the annular lip 160 formed by the body 162 of the closure. In this way, the skirt extension is made easier to grip so that the closure can be readily turned about its vertical central axis.

Because the closure 154 is constructed for a larger container such as a paint can, it will be understood that it is made of a thicker, stronger plastic sheet material. Suitable plastics that can be used include polypropylene and polyethylene. It will be understood that the plastic sheet material must be selected so that it has sufficient strength and rigidity to properly contain the paint within the can for all normal conditions of use.

Additional features of the closure 154 that can be seen in the figures include a circular top or cap part 164, a downwardly sloping sheath part 166 and an intermediate part 168. A suitable hole 170 is formed in one side of the sheath part. In the closed position shown in FIG. 22, this hole can be sealed shut by means of a protuberance 172, this protuberance being formed on the intermediate part 168. Air holes 174 can be formed on opposite sides of the sheath part 166, if desired or necessary. If desired, protuberances can be provided on the intermediate part 168 to close sealingly the air holes 174 in the closed configuration.

FIG. 23 illustrates the closure 154 in an intermediate open position which allows paint (or any other liquid in the container) to flow out through the hole 170. In this position, the closure has been pried upwardly on one side only, that is on the side of the hole 170. However, if desired, the upper portion of the closure can be fully raised to the position illustrated in FIG. 24. Movement of the closure to this position may be desirable, for example, for cleaning the lid. Particularly for a paint can lid, it can be important to clean off the interior of the lid so that it will function properly for future use purposes. With the closure in the position shown in FIG. 24, it is relatively easy to remove all of the material such as paint from the interior of the closure. Once the cleaning operation has been completed, the lid can be restored to the closed position shown in FIG. 22.

Finally, it is to be understood that while several preferred embodiments of the present invention are herein shown and described, various changes in size and shape of parts can be made. For example, whereas the connection means for sealing the body to the container in the preferred embodiment comprise a groove to receive the rim of the container, it will be evident that the body and the container may, for example, be formed integrally, in which case the connection means will constitute a physical connection between the body and the container, and the rim will be a notional structure. As well, it will be readily understood that the invention is not limited to beverage containers and paint cans, but may be utilized with equal utility in combination with other larger containers. Similarly, whereas the closure of the preferred embodiment is annular, and relatively "affixed" at one side the body may take other shapes, for example, rectangular, akin to an accordion, or polygonal, and may "open" from all sides. Also, whereas the structure illustrated in the preferred embodiment contemplates its construction from a precursor structure, it will be evident that such precursor structure is not necessary. Yet further, whereas in the preferred embodiment, sealing of the passage is effected by the interior surface, it is possible to seal the passage by the exterior surface, for example, by provision of an externally-projecting protuberance on the insert part, and by locating the passage through the intermediate part of the body.

It will be evident that these modifications, and others which may be obvious to persons of ordinary skill in the art, may be made without departing from the spirit or scope of the invention, which is accordingly limited only by the claims appended hereto, purposively construed.

The invention claimed is:

1. A disposable beverage cup lid for a container having an opening bounded by a rim, said cup lid comprising:

a sheath part, an insert part, a cap part and an intermediate part, the sheath part being annular, having an aperture defined therethrough and having a first end and a second end, the cap part occluding the second end of the sheath part, the insert part being shaped and dimensioned to be received within the sheath part in spaced relation, wherein the sheath part is secured to the insert part at a side opposite to that in which the aperture is formed;

the intermediate part being flexibly connected to the first end of the sheath part and the insert part and extending therebetween such that the sheath part, insert part, cap part and intermediate part together define a body having an interior surface and an exterior surface;

connection means for sealing the body to the container in use such that the insert part extends outwardly from the container and such that the interior surface defines an interior space into which the opening of said container opens during use of said closure;

a tubular pedestal rigidly extending between and connecting an insert part first end to said connection means said body being selectively deformable, upon manual manipulation, between an open configuration, wherein the interior space is in fluid communication with the aperture, and a closed configuration, wherein, upon manual manipulation to the closed configuration, the intermediate part collapses into the sheath part in form-fitting relation to seal the aperture and the insert part is collapsed into the intermediate part; and said insert part first end constructed of a smaller external dimension than said first end of said sheath part, thereby to define, in the closed configuration, an overhanging lip extending radially beyond said tubular pedestal, which can be pried upwardly by fingers of a user.

2. A disposable beverage cup lid according to claim 1, wherein the open configuration is a static open configuration wherein the body is stable without an external application force.

3. A disposable beverage cup lid according to claim 2, wherein the closed configuration is a static closed configuration wherein the body is stable without an external application of force.

4. A disposable beverage cup lid according to claim 1, wherein the interior surface defines a protuberance which projects through the aperture when the body is in the closed configuration.

5. A disposable beverage cup lid according to claim 1 wherein said connection means comprises a skirt which extends peripherally around and is operatively connected to the body, the skirt having a peripherally extending groove therein shaped and dimensioned to frictionally, sealingly, and releasably receive said rim.

6. A disposable beverage cup lid according to claim 1, wherein the sheath part is frustoconical and tapers towards its second end;

the insert part is frustoconical and has a second end, the second end of the insert part being shaped and dimensioned to be received within the sheath part in spaced relation; and the intermediate part is frustoconical and flexibly connected to the first end of the sheath part and the second end of the insert part.

7. A disposable beverage cup lid according to claim 6 wherein, in the open configuration, the insert part and the intermediate part are disposed at least partially outside of the sheath part in sections thereof adjacent said aperture.

8. A disposable beverage cup lid according to claim 6 wherein, in the closed configuration, the insert part is disposed, in substantially form-fitting, nested relation, within the intermediate part, and the intermediate part is disposed, in nested relation, within the sheath part.

9. A disposable beverage cup lid according to claim 6 wherein a pair of vent holes are formed in the sheath part on circumferentially opposite sides of said aperture.

10. A disposable beverage cup lid according to claim 6 wherein said connection means comprises a skirt which extends peripherally around and is operatively connected to the body, the skirt having a peripherally extending groove therein shaped and dimensioned to sealingly and releasably receive said rim.

11. A disposable beverage cup lid according to claim 6 further comprising a tubular pedestal part rigidly extending between and connecting the first end of the insert part to said connection means which comprises a skirt.

12. A disposable beverage cup lid according to claim 6 wherein the cap part forms an interiorly disposed protuberance which, when the body is in the closed configuration, sealingly engages against the intermediate part.

* * * * *